US006012554A

United States Patent [19]

Ito et al.

[11] Patent Number: 6,012,554

[45] Date of Patent: Jan. 11, 2000

[54] ELEVATOR GUIDE RAIL

[75] Inventors: Hideki Ito, Yokohama; Kazuhiko Motomura, Youkaichiba, both of Japan

[73] Assignee: Otis Elevator Company, Farmington, Conn.

[21] Appl. No.: 08/962,305

[22] Filed: Oct. 31, 1997

[51] Int. Cl.[7] ..... B66B 7/02

[52] U.S. Cl. ..... 187/406

[58] Field of Search ..... 187/406, 408, 187/414, 404, 405, 410

[56] References Cited

U.S. PATENT DOCUMENTS 3,211,259 10/1965 Tofanelli ..... 187/95
5,429,211 7/1995 Aulanko et al. ..... 187/254
5,469,937 11/1995 Hakala et al. ..... 187/266

FOREIGN PATENT DOCUMENTS 2242318 3/1975 France .
2157654 10/1985 United Kingdom .

*Primary Examiner*—Kenneth W. Noland

[57] ABSTRACT

An elevator guide rail includes a central portion and a pair of lateral portions. The central portion has a U-shaped cross section and the lateral portions have an L-shaped cross section. The lateral portions are installed on both sides of central portion. The two flanges of the central portion include shaped edge sections. The lateral portions are received within edge sections.

5 Claims, 5 Drawing Sheets

ELEVATOR GUIDE RAIL

DESCRIPTION

Technical Field

The present invention relates to elevators, and more particularly to guide rails for elevators.

Background of the Invention

A conventional elevator is illustrated in FIG. 7. In the figure, a car (101) is installed in a manner such that it can freely move up and down in an elevator hoistway (102). A counterweight (103) is also installed to balance with this car (101). One end of a rope (104) is attached to the car (101), and the other end is attached to the counterweight (103). This rope (104) extends over a drive sheave (105*a*) and a deflector sheave (106) of a hoist machine (105). On both sides respectively of the car (101 ) and the counterweight (103), car guide rails (107) and counterweight guide rails (108) are installed. When the machine (105) is driven, both the car (101) and the counterweight (103) move up and down respectively along the car guide rails (107) and the counterweight guide rails (108). A drawback to this type of conventional elevator is the increased installation work because the car guide rails (107) and the counterweight guide rails (108) need to be installed and aligned separately.

Disclosure of the Invention

An object of the present invention is to facilitate installation of an elevator by integrating car guide rails and counterweight guide rails.

Another object is a guide rail formed from conventionally available structural materials.

According to the present invention, a guide rail includes a central portion having a pair of flanges, and a pair of lateral portions that mate with the flanges to define guiding surfaces for both the car and counterweight.

According to a particular embodiment, the combined car and counterweight guide rail is composed of a central portion that has a U-shaped cross section and of a pair of lateral portions that have an L-shaped cross sections. The lateral portions are installed on both sides of the central portion. The two flanges of the central portion are bent back to form shaped edge sections. The lateral portions are received within the edge sections.

An advantage of the present invention is the ease of installation of the guide rails. Since both the car and counterweight guide rails are integrated into a single structure, they are installed simultaneously. This eliminates the need to separately install car and counterweight guide rails and minimizes the effort in aligning the guide rails. Another advantage is the use of readily available materials to form the guide rails. In one embodiment, the rails are formed from sheet material that is shaped into the appropriate form. As an alternative, conventional U-shaped channels and L-shaped materials may be used.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 5:
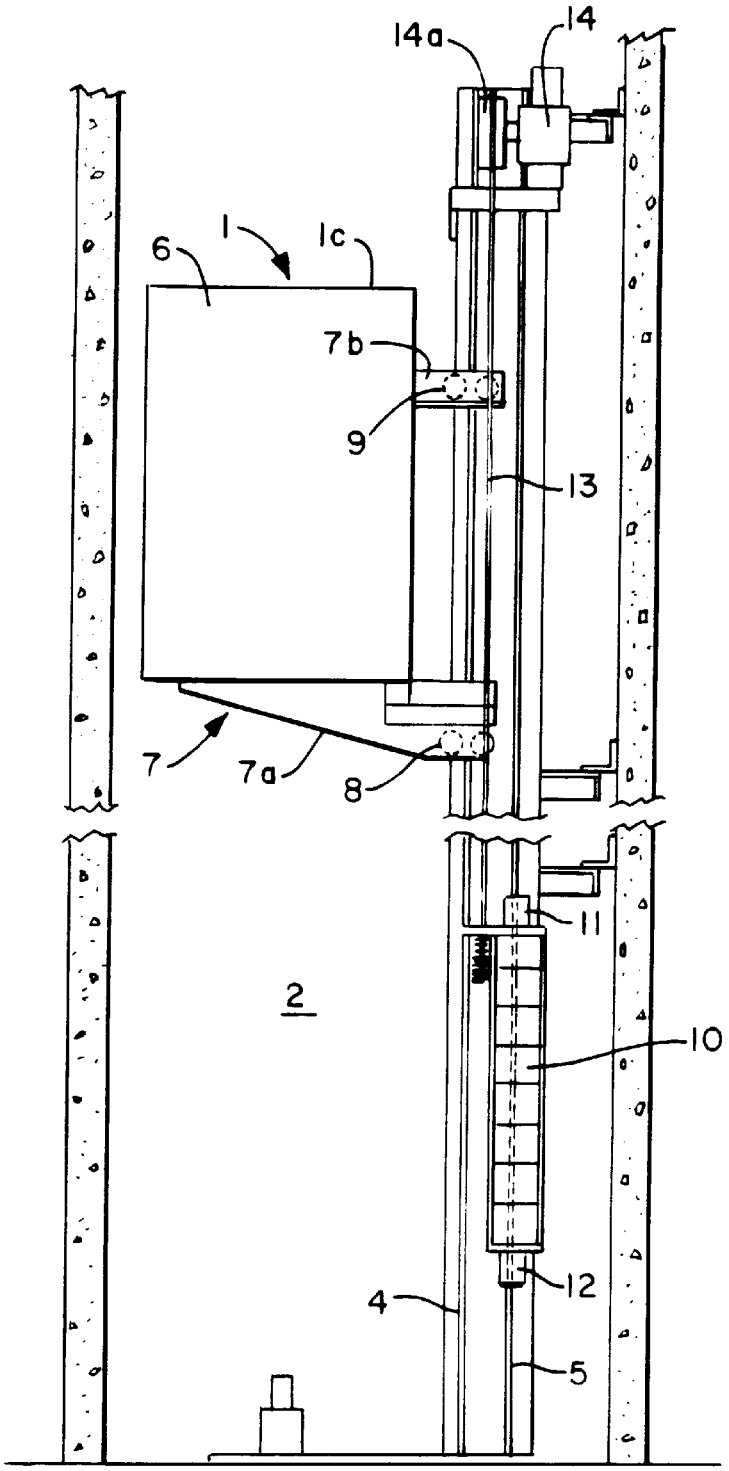
FIG. 5 is a side view of an elevator with the combined guide rail.
Figure 6:
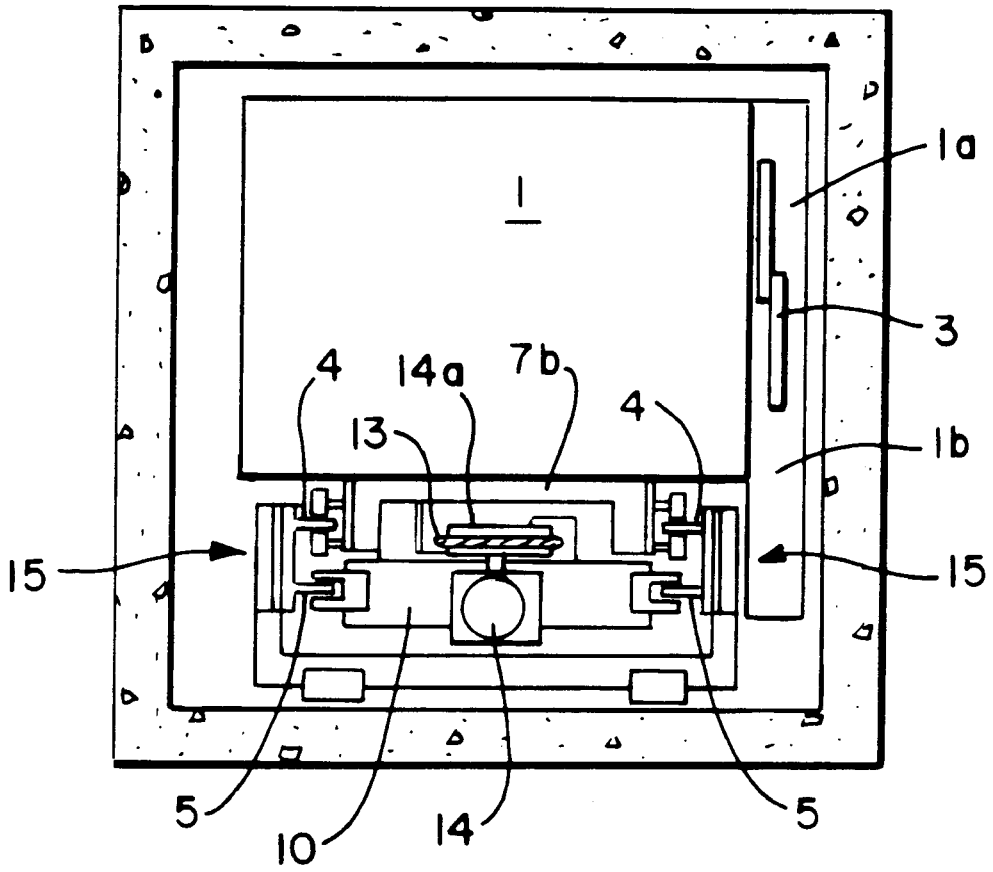
FIG. 6 is a front view of the elevator with the combined guide rail.
Figure 7:
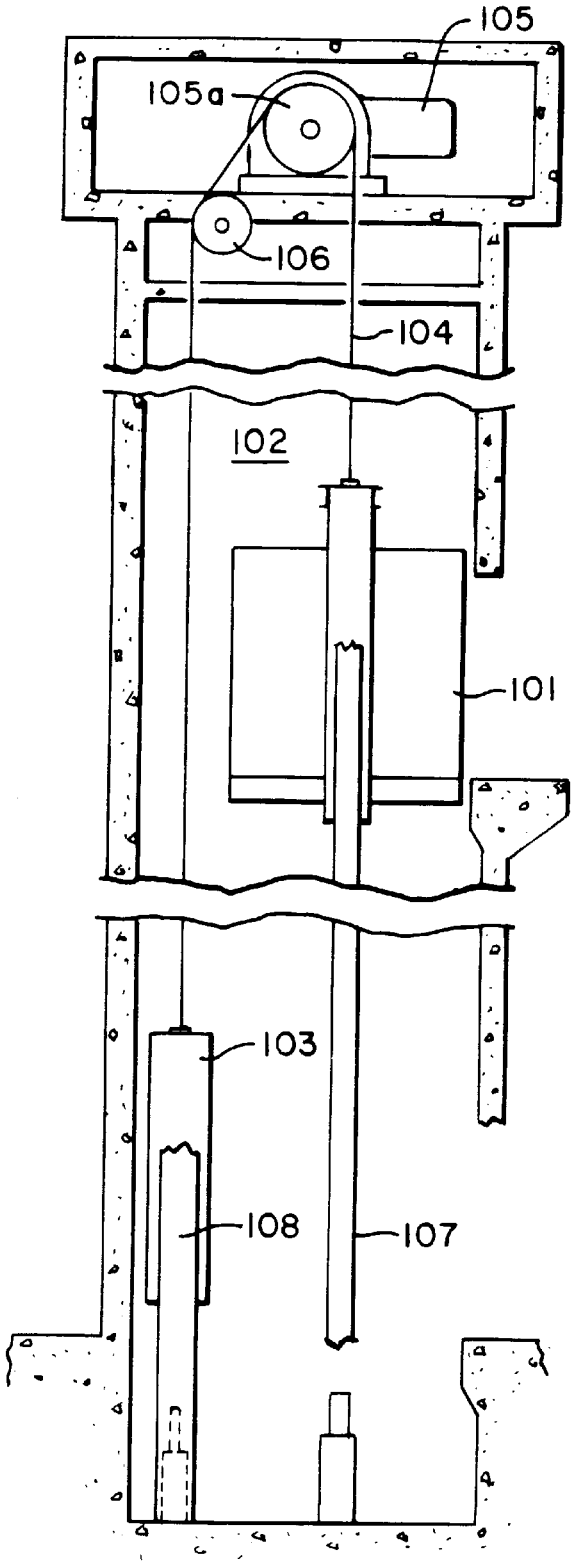
FIG. 7 PRIOR ART
FIG. 7 is a side view of a conventional elevator.

In FIGS. 5 and 6, a car (1) is installed in an elevator hoistway (2) in a manner such that it can freely move up and down. At the entrance/exit (1*a*) of this car (1), a cab door (3) is installed in a manner such that it can freely open and close. Also at the entrance/exit (1*a*), a door pocket (1*b*) is provided to store the door (3) when it is opened. On the side of the door pocket on the car (1), both the car guide rail (4) and the counterweight guide rail (5) are vertically installed together. Because of this, the elevator hoistway (2) is made compact in the direction of horizontal cross section.

The car (1) comprises a cab (6) and a frame (7) which supports this cab (6). This car frame (7) comprises a lower frame (7*a*) which is provided on the floor surface of the cab (6), and a side frame (7*b*) which is installed on the side face in the door pocket side of the cab (6). The side frame (7*b*) is positioned on the side face of the car (1) at a position slightly below the upper end (1*c*) (that is, the ceiling). At the tip of both the lower frame (7*a*) and the side frame (7*b*) of the car frame (7), roller guides (8) and (9) are provided. These roller guides (8) and (9) are engaged with the car guide rail (4) in a manner that they can freely slide.

Also, in the elevator hoistway (2), a counterweight (10) is placed to balance with the car (1). On both the upper and the lower ends of this counterweight (10), guide shoes (11) and (12) are provided. These guide shoes (11) and (12) are engaged with the counterweight rail (5) in a manner such that they can freely slide. On the upper end of the counterweight (10), one end of the rope (13) is attached, and the other end of this rope (13) is attached to the lower frame (7*a*) of the car frame (7).

The rope (13) extends over the drive sheave (14*a*) of a hoist machine (14) that is disposed on the upper part of both the car guide rail (4) and the counterweight guide rail (5). As a result, the load of the car, counterweight and hoist machine are carried by the guide rail structure. When the car (1) is positioned on the top floor, the hoist machine (14) is positioned beside this car (1).

Figure 1:
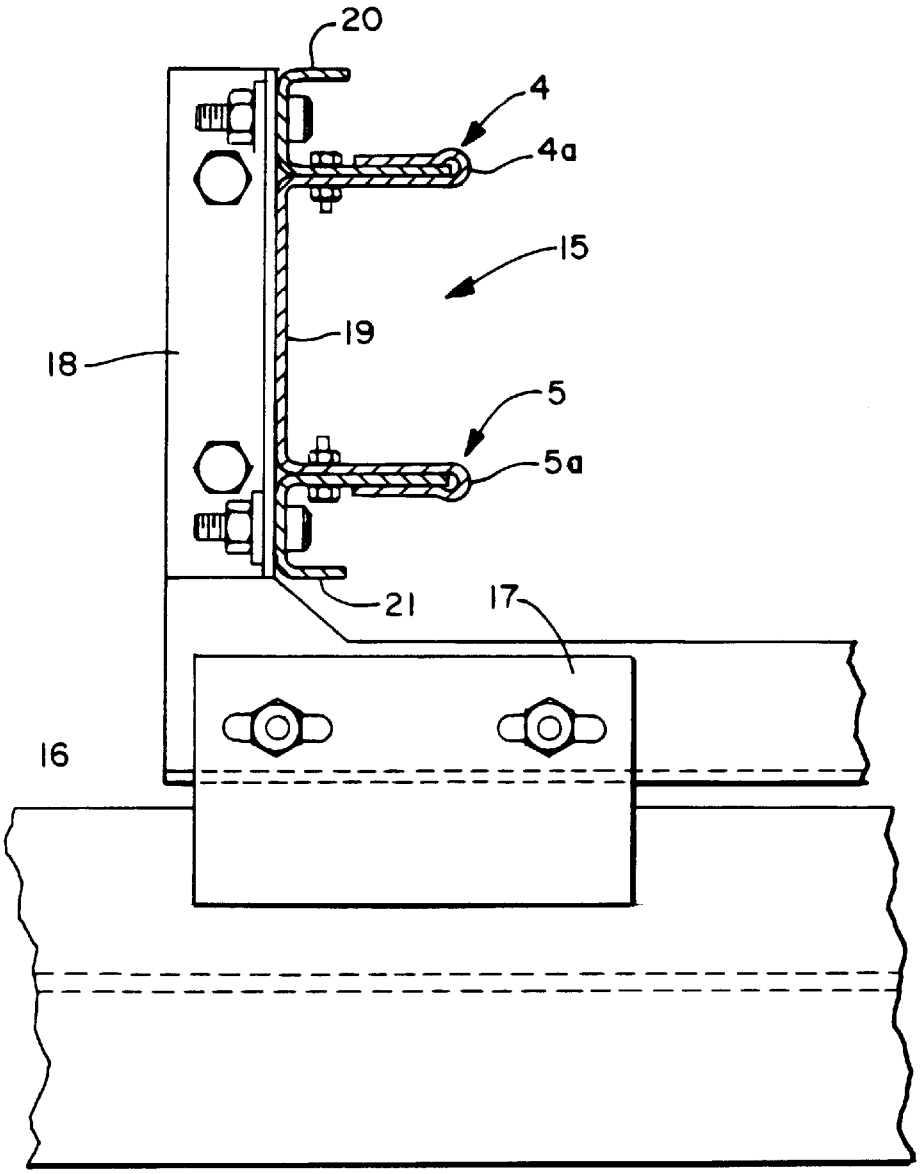
FIG. 1 is a cross-sectional view that illustrates a combined elevator guide rail in accordance with the present invention.

The car guide rail (4) and the counterweight guide rail (5) are combined as illustrated in FIG. 1 to constitute a integral guide rail (15). The combined guide rail defines the guiding surfaces for both the car (1) and the counterweight (10). The combined guide rail (15) is fixed to the structure of the elevator hoistway (2) by means of a support piece (17) and a rail bracket (18).

Figure 2:
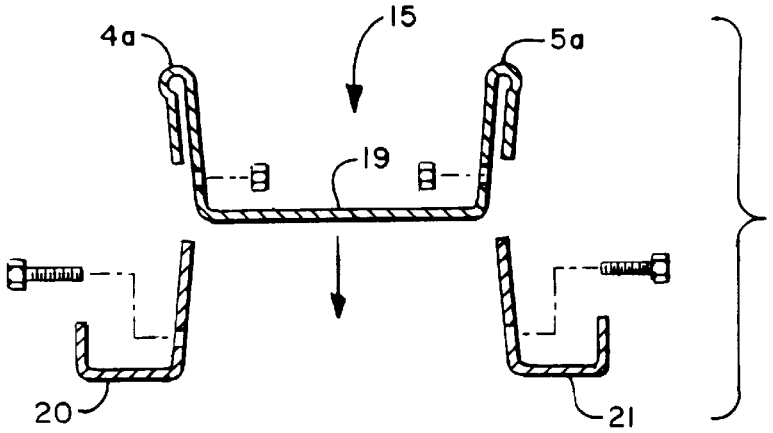
FIG. 2 is an exploded cross-sectional view of the combined guide rail.

As illustrated in FIG. 2, the combined guide rail (15) comprises a central portion (19) and a pair of lateral portions made of sheet steel. The central portion includes a base and a pair of flanges extending outward from the base to form a generally U-shaped cross section. The lateral portions (20) and (21) include a first side and a second side arranged to form a generally L-shaped cross section. The lateral portions (20) and (21) are arranged on both sides of the central portion (19), with one of the sides mating with one of the flanges of the central portion. Both left and right flanges of the central portion (19) are shaped to form an edge section (4*a*) of the car guide rail (4) and the edge section (5*a*) of the counterweight guide rail (5). The shaped edge sections (4*a*) and (5*a*) define a cavity in which the lateral portions (20) and (21) are respectively inserted and received. As a result, the guiding surfaces are defined by the central portion (19) and the shaped edge sections (4*a*) and (5*a*). Although shown as having a central portion with shaped edge sections, it should be apparent to one skilled in the art that the lateral portions may be configured with the shaped edge portions such that the flanges of the central portion are received within the lateral portions. In this configuration, the guiding surfaces would be defined by the lateral portions.

The left and right sides of the central portion (19) are extruded and pressed to have a U-shaped cross section that opens outwards in the left and the right by means of the remaining stress. The pair of lateral portions (20) and (21) are extruded and pressed to have an L-shaped cross section that opens inward in the left and the right sides by means of the remaining stress. Thus, combining and fastening the central portion (19) and the lateral portions (20) and (21) will produce the desired opening of the combined guide rail (15). Therefore, the shapes of the edge sections (4*a*) and (5*a*) are maintained in the correct shape as designed.

Figure 3:
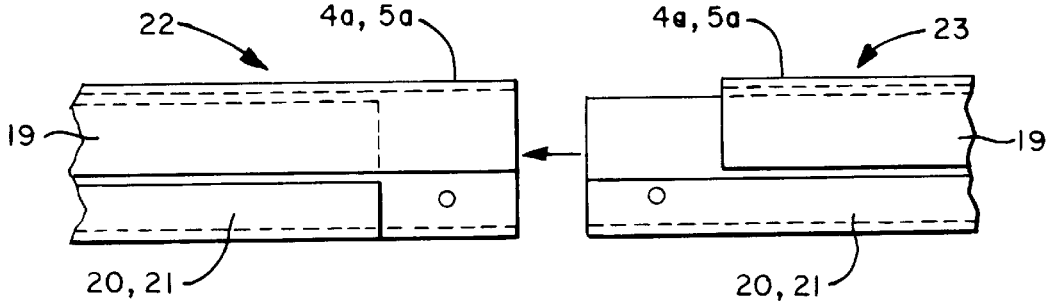
FIG. 3 is an exploded side view of this combined guide rail.
Figure 4:
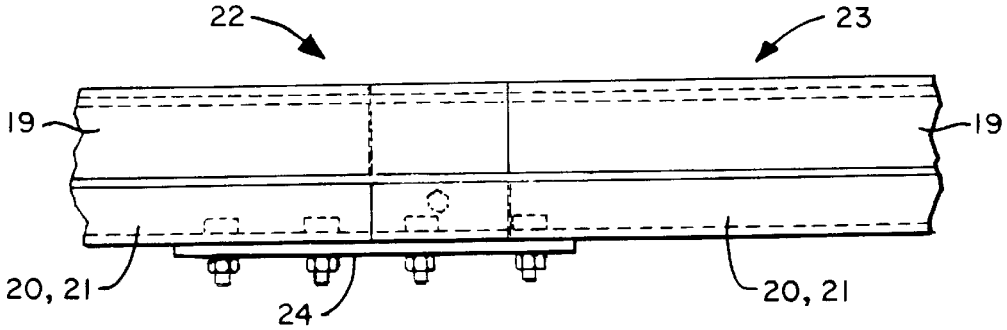
FIG. 4 is a side view of this combined guide rail.

As illustrated in FIG. 3, the combined guide rail (15) is extended through the hoistway by connecting multiple rail structures (22) and (23). The longitudinal ends of the central portion (19) and the lateral portions (20) and (21) are slightly displaced on the rail structures (22) and (23). Thus, the lateral portions (20) and (21) of one rail structure (23) can be inserted in the central portion (19) of the adjacent rail structure (22). In this manner, the edge sections (4*a*) and (5*a*) of the rail structure (22) and the edge sections (4*a*) and (5*a*) of the rail structure (23) will mate. As a result, there will be no step at the connection part of the edge sections. Then, as illustrated in FIG. 4, the central portion (19) of the rail structure (22) and the lateral portions (20) and (21) of the rail structure (23) are joined with bolts, and furthermore, joined with bolts by means of a splice plate (24).

As explained above, by the present invention, because a combined guide rail wherein both the car guide rail and the counterweight guide rail are combined is constructed, the installation work will be simple as this guide rail only needs to be installed and aligned once.

Although the embodiment shown and described in FIGS. 1–6 discloses a combined guide rail formed from shaped sheet material, it should be understood that the other materials may be used to assemble the combined guide rail. For example, conventional U-shaped channels may be used for the central portion and conventional L-shaped structures may be used as the lateral portions and mated with the channels to form the combined guide rail. In addition, the central portion and lateral portions may be simply fastened or bonded together without a shaped edge portion to receive either the central or lateral portion. In this configuration, the guiding surface would be defined in part by the flange of the central portion and in part by the first side of the lateral portion.

Although the invention has been shown and described with respect to exemplary embodiments thereof, it should be understood by those skilled in the art that various changes, omissions, and additions may be made thereto, without departing from the spirit and scope of the invention.

What is claimed is:

1. A guide rail for an elevator car and counterweight, the guide rail including:

a central portion having a base and two flanges extending outward from the base; and a pair of lateral portions, each lateral portion having a first side and a second side, each first side mating with and fastened to one of the two flanges to define a guiding surface, wherein each of the lateral portions is formed from a structure having an L-shaped cross-section, and wherein one of the guiding surfaces is for the car and the other guiding surface is for the counterweight.

2. The guide rail according to claim 1, wherein the central portion is formed from a structure having a U-shaped cross-section.

3. A guide rail for an elevator car and counterweight, the guide rail including:

a central portion having a base and two flanges extending outward from the base; and a pair of lateral portions, each lateral portion having a first side and a second side, each first side mating with and fastened to one of the two flanges to define a guiding surface, and wherein one of the guiding surfaces is for the car and the other guiding surface is for the counterweight;

wherein one of either the flange or first side of each guiding surface includes a shaped edge section that defines a cavity, wherein the cavity receives the other of the flange or first side.

4. The guide rail according to claim 3, wherein the edge section defines in part the guiding surface.

5. The guide rail according to claim 3, wherein the central portion is formed from a structure having a U-shaped cross-section.

* * * * *